US011192010B2

(12) United States Patent
Areskog

(10) Patent No.: US 11,192,010 B2
(45) Date of Patent: Dec. 7, 2021

(54) PORTABLE OUTDOOR GAME KIT

(71) Applicants: Cris Areskog, Charlotte, NC (US); Michael Karaffa, Charlotte, NC (US)

(72) Inventor: Cris Areskog, Charlotte, NC (US)

(73) Assignees: Chris Areskog, Charlotte, NC (US); Michael Karaffa, Charlotte, NC (US)

( * ) Notice: Subject to any disclaimer, the term of this patent is extended or adjusted under 35 U.S.C. 154(b) by 0 days.

(21) Appl. No.: 16/832,754

(22) Filed: Mar. 27, 2020

(65) Prior Publication Data

US 2020/0306608 A1 Oct. 1, 2020

Related U.S. Application Data

(60) Provisional application No. 62/824,402, filed on Mar. 27, 2019.

(51) Int. Cl.
*A63B 67/06* (2006.01)
*A63B 71/00* (2006.01)

(52) U.S. Cl.
CPC ..... *A63B 67/066* (2013.01); *A63B 71/0036* (2013.01); *A63B 2067/061* (2013.01); *A63B 2209/00* (2013.01)

(58) Field of Classification Search
CPC ..... A63B 57/40; A63B 63/00; A63B 67/06; A63B 67/066; A63B 2067/061
See application file for complete search history.

(56) References Cited

U.S. PATENT DOCUMENTS 4,596,391 A * 6/1986 Carolan, Jr. ..... A63B 67/02 473/158
4,842,134 A * 6/1989 Chang ..... A45C 13/02 206/315.1
5,125,669 A 6/1992 Kanda
5,465,962 A 11/1995 Hiserman
5,516,108 A * 5/1996 Foster ..... A63B 67/02 473/158

(Continued)

FOREIGN PATENT DOCUMENTS

FR 2823129 A3 * 10/2002 ..... A63B 67/066

OTHER PUBLICATIONS

English machine translation of FR 2,823,129 A3 (Year: 2002).*
V:King Game Rules, http://playvking.com/docs/vking_rules.pdf, archived by Internet Archive on Dec. 3, 2011 (Year: 2011).*

*Primary Examiner* — Laura Davison
(74) *Attorney, Agent, or Firm* — Shumaker, Loop & Kendrick, LLP

(57) ABSTRACT

Disclosed herein is a portable outdoor game kit that includes (a) a portable carrying case; (b) a boundary configured to be positioned on a ground surface and formed into a predetermined shape; (c) a plurality of targets configured to be positioned within the boundary when the boundary is positioned on the ground surface and formed into the predetermined shape; (d) a plurality of offensive implements configured for throwing towards and/or into at least one of the plurality of targets while the game kit is in use; and (e) a plurality of blocking implements configured to block or impede movement of the offensive implements towards the plurality of targets while the game kit is in use. Also disclosed herein is a method of playing a game with the disclosed portable outdoor game kit.

13 Claims, 8 Drawing Sheets

(56) References Cited

U.S. PATENT DOCUMENTS

| | | | | |
|---|---|---|---|---|
| 5,749,789 | A * | 5/1998 | Karl | A63B 67/02 473/158 |
| 7,731,196 | B2 | 6/2010 | Scoccia | |
| 8,951,135 | B1 * | 2/2015 | Guyer | A63B 67/02 473/153 |
| 2004/0180737 | A1 * | 9/2004 | Reading | A63B 67/066 473/490 |
| 2007/0037629 | A1 * | 2/2007 | Neal | A63B 67/02 473/157 |
| 2012/0065004 | A1 * | 3/2012 | Blackwell | A63B 71/0669 473/476 |
| 2019/0308082 | A1 * | 10/2019 | Hudgins | A63B 67/066 |

* cited by examiner

31

PORTABLE OUTDOOR GAME KIT

TECHNICAL FIELD

The present invention relates generally to the field of game and game kits, and more particularly, to portable outdoor game kits and game(s) intended to be played on sand (e.g., beaches), grass, or other ground surfaces.

BACKGROUND

Numerous outdoor games and/or game kits exist. The existing games and/or game kits primarily focus on a user's offense in which each user attempts to score points by throwing or rolling some form of projectile and/or game implement towards a target. Bocce ball and corn hole are two such games. It should be noted that the game implements used in bocce ball and corn hole generally have the same size and shape and are not solely intended as defensive/blocking implements to block another user while they aim for a target.

For example, U.S. Pat. No. 5,125,669 "Court game apparatus and method of using same" discloses a transportable playing court, having non-ball-confining boundaries, a target ball, and a plurality of server player balls and non-server player balls.

As another example, U.S. Pat. No. 7,731,196 "Tossed Projectile Game" merely discloses a game for tossing a projectile at multiple openings on a game field to encourage hand-eye coordination.

As yet another example, U.S. Pat. No. 5,465,962 "Ball Rolling Game" discloses a ball rolling game for rolling balls towards and/or into targets and/or scoring zones.

Although the existing games and/or game kits having implements, projectiles, and/or balls may be inadvertently used for defensive purposes, none of these games and/or game kits disclose or suggest implements and/or projectiles solely intended for defensive purposes to limit and/or impede a user's aim at a target thereby strategically reducing a competitor's chance for obtaining points by contacting, blocking, and/or coming into close proximity to a target.

BRIEF SUMMARY

Disclosed herein is a portable outdoor game kit that includes blocking implements that may be solely used for defensive purposes to limit and/or impede a user's aim at a target. The portable outdoor game kit disclosed herein includes (a) a portable carrying case; (b) a boundary stored within the portable carrying case that is configured to be positioned on a ground surface and formed into a predetermined shape; (c) a plurality of targets stored within the portable carrying case that are configured to be positioned within the boundary when the boundary is positioned on the ground surface and formed into the predetermined shape; (d) a plurality of offensive implements stored within the portable carrying case that are configured for throwing towards and/or into at least one of the plurality of targets while the game kit is in use; and (e) a plurality of blocking implements stored within the portable carrying case that are configured to block and/or impede movement of the offensive implements towards the plurality of targets while the game kit is in use.

In certain aspects, the boundary is flexible (e.g., non-resiliently deformable).

In certain aspects, the boundary is a flexible endless rope.

In certain aspects, the flexible endless rope is configured to rest on the ground while maintaining the predetermined and/or desired formed shape.

In certain aspects, the game kit further includes anchoring members configured to anchor the flexible endless rope to the ground surface and maintain the predetermined and/or desired formed shape. When included, the anchoring members may also be stored within the carrying case.

In certain aspects, each target has a rigid, outer periphery that defines an opening for receiving the offensive implement therein while the game kit is in use.

In certain aspects, the rigid, outer periphery has a planar surface such that the rigid, outer periphery is substantially parallel to the ground surface while in use.

In certain aspects, each target further comprises rigid legs connected to and extending away from the rigid, outer periphery.

In certain aspects, each rigid leg is configured to be driven into the ground surface thereby temporarily anchoring the target into the ground surface.

In certain aspects, each of the offensive elements comprises spherical structures.

In certain aspects, the spherical structures are balls having the same outer diameter.

In certain aspects, the balls are hollow or solid.

In certain aspects, the balls are solid.

In certain aspects, each blocking implement is a solid, elongate structure having a predetermined shape.

In certain aspects, the predetermined shape is rectangular or triangular.

In certain aspects, the predetermined shape is rectangular.

Also disclosed herein is a method of playing a game with the disclosed portable outdoor game kit.

Additional features, aspects and advantages of the invention will be set forth in the detailed description, which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention maybe embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
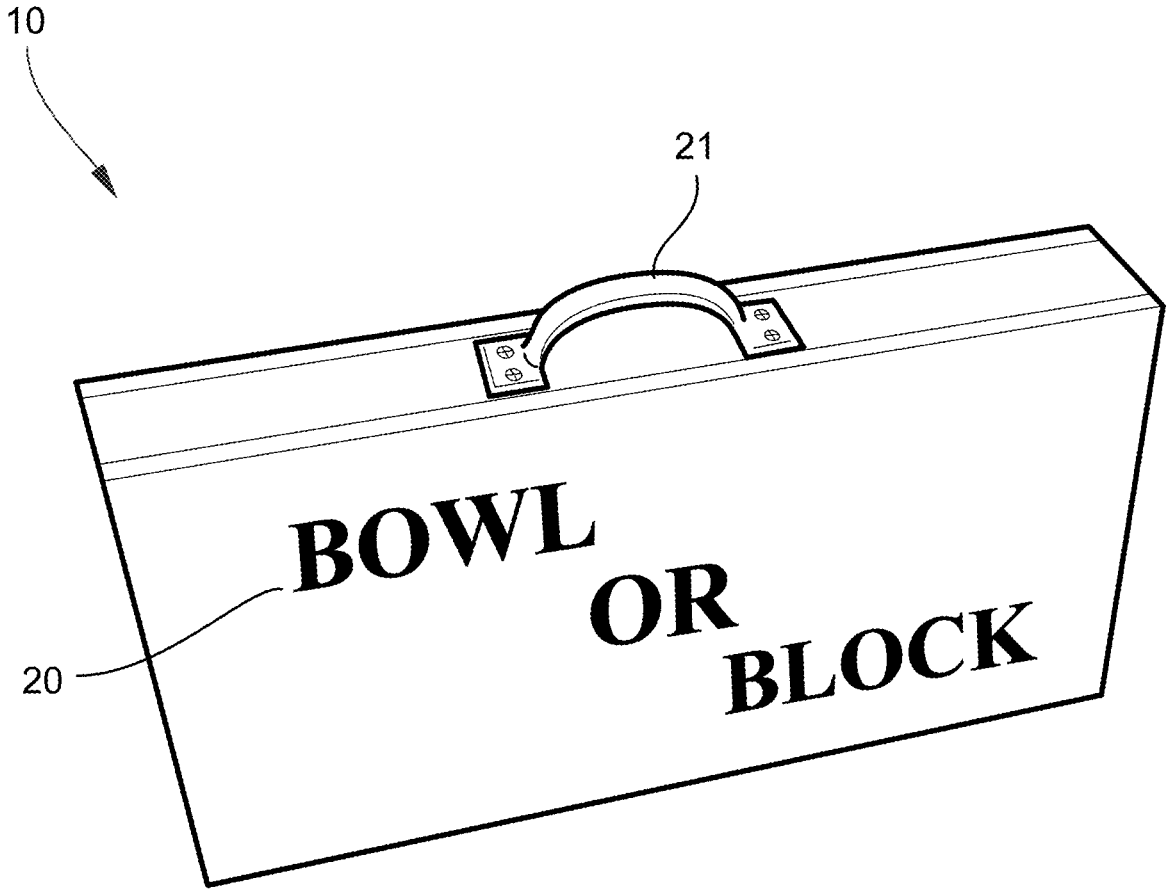
FIG. 1 depicts a perspective view of the carrying case for the outdoor game kit according to an embodiment of the invention.
Figure 2:
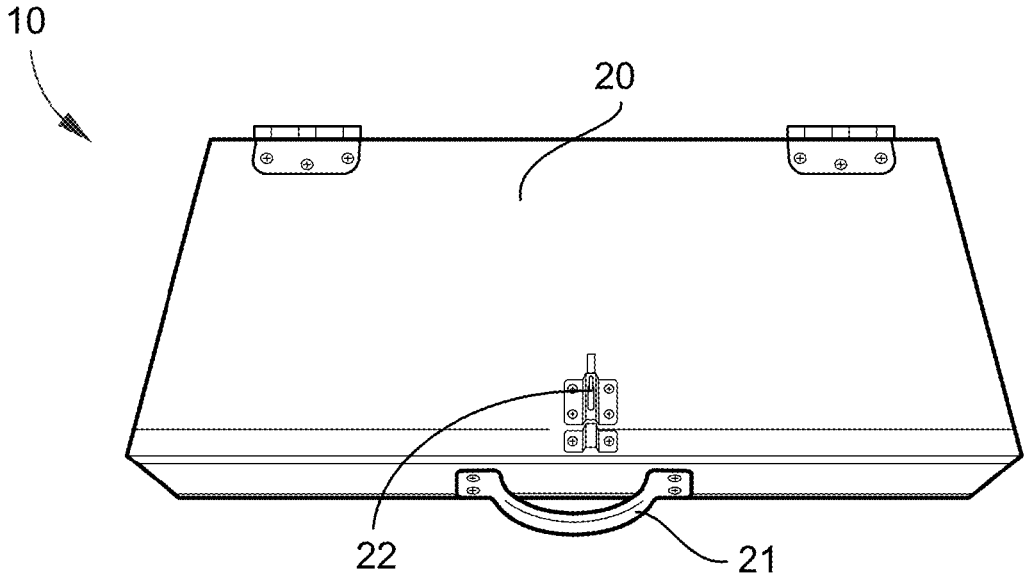
FIG. 2 depicts a bottom view of the carrying case for the outdoor game kit.

Referring to FIGS. 1-7, disclosed herein is a portable outdoor game kit 10 that includes a plurality of blocking implements 70 that may be solely used for defensive purposes to limit and/or impede a user's aim at target 50. FIGS. 1 and 2 specifically depict the portable carrying case 20 of the portable outdoor game kit 10 that is configured to open and close. FIGS. 1 and 2 depict the carrying case 20 in a closed conformation, and FIGS. 1 and 2 further show that the portable carrying case 20 includes a handle 21 for ease of transporting the game kit 10 from location to location and further includes a locking mechanism 22 for securing the individual pieces/components of the game kit therein.

Figure 3:
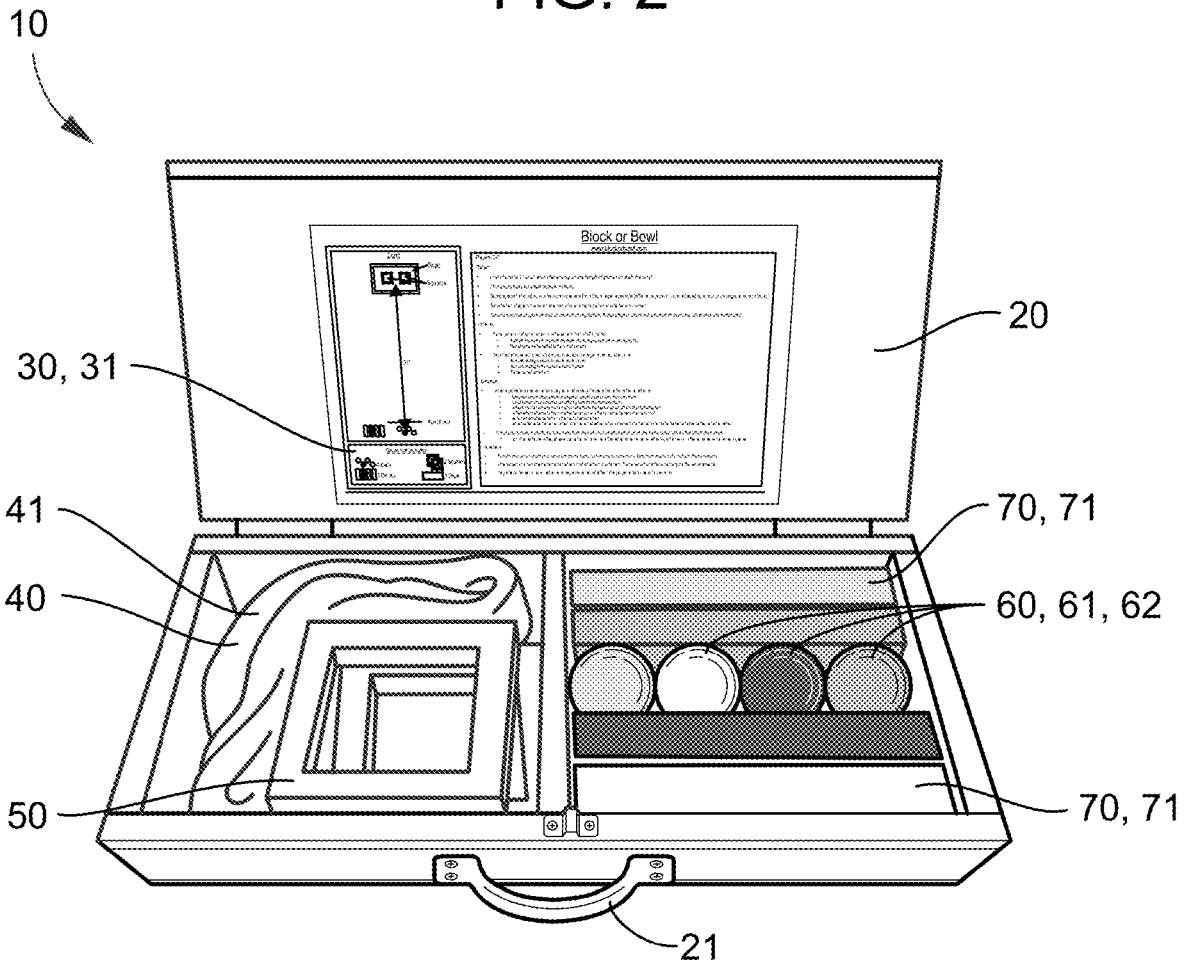
FIG. 3 depicts the carrying case being opened and including all pieces/components and instructions of the game kit therein.

FIG. 3 depicts the portable carrying case 20 of the game kit 10 in an open conformation and further depicts the individual components of the game kit stored therein. As specifically shown in FIG. 3, a boundary 40 is stored within the portable carrying case 20 that is configured to be positioned on a ground surface (sand (e.g., at the beach), grass, and/or clay surfaces) and formed into a predetermined and/or desired shape. In certain aspects, the boundary 40 is not rigid, but instead comprises a flexible material so that the boundary maybe easily formed into any desired shape. For example and as further shown in FIGS. 5 and 7, the boundary 40 may be a flexible endless rope 41 capable of being formed into and maintaining a desired shape that includes, for example, a rectangle, square, circle, or triangle shape. As alluded to above and as further shown in FIGS. 5 and 7, the flexible endless rope 41 is configured to rest on the ground while maintaining the predetermined shape (e.g., non-resiliently deformable). In certain aspects, the game kit 10 further includes anchoring members (not shown) configured to anchor and temporarily affix the flexible endless rope 41 to the ground surface and maintain the predetermined shape. When included, the anchoring members may also be stored within the carrying case 20.

Figure 4:
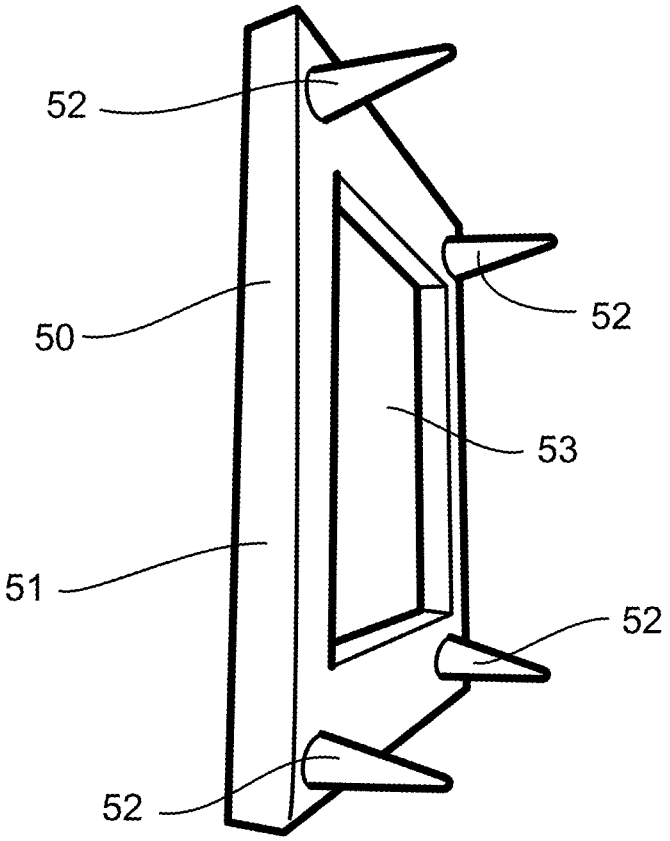
FIG. 4 depicts a side view of one target of the game kit.
Figure 5:
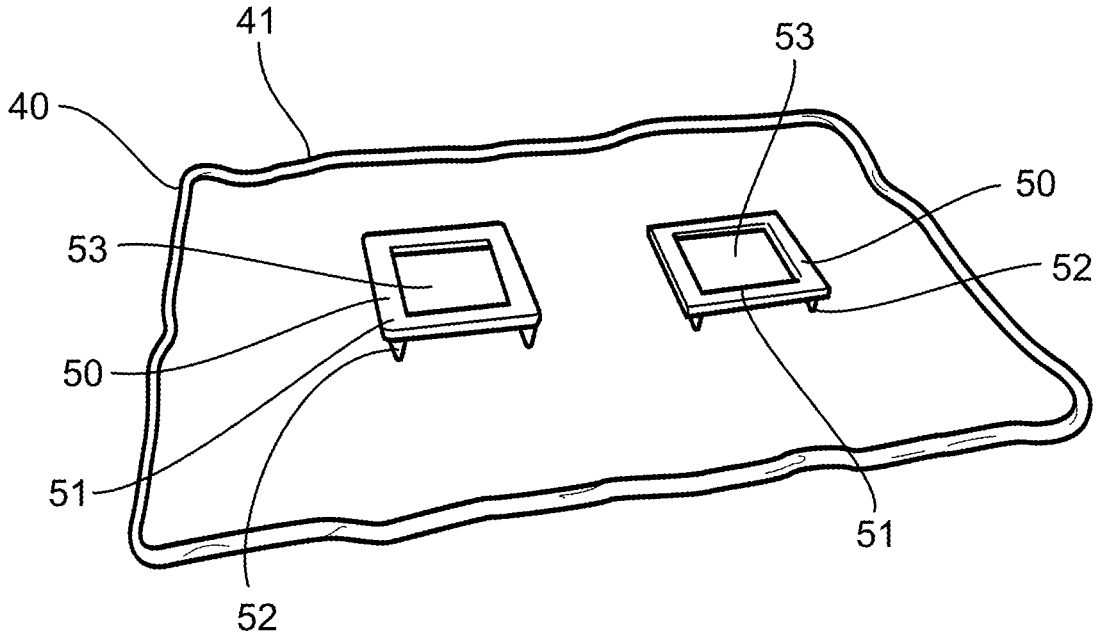
FIG. 5 depicts a boundary arranged to have a predetermined/desired shape and a plurality of targets included therein.
Figure 6:
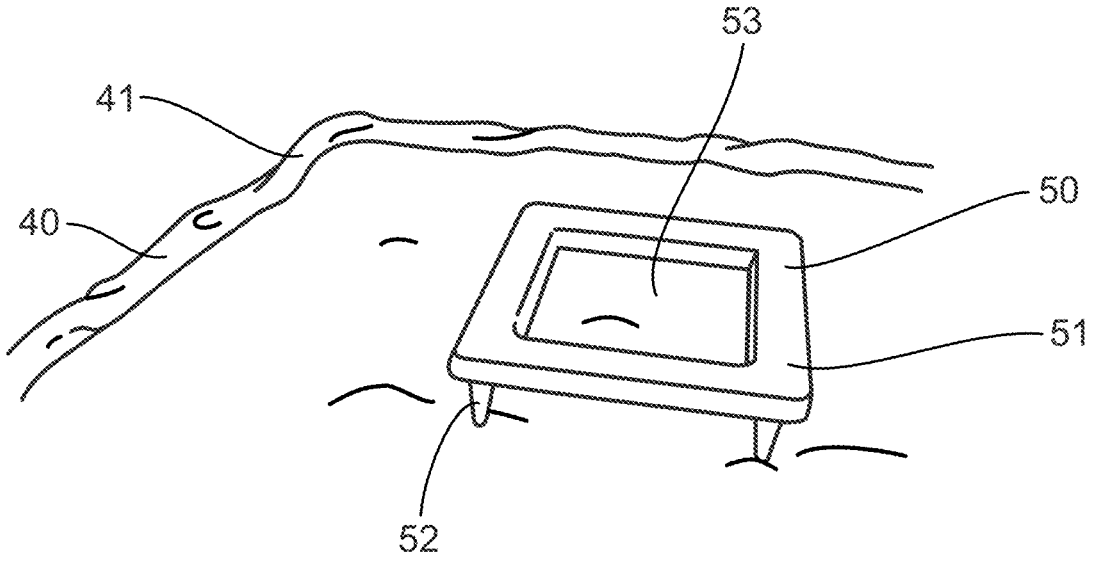
FIG. 6 depicts a magnified view of FIG. 5 specifically showing portions of the boundary and one target.
Figure 7:
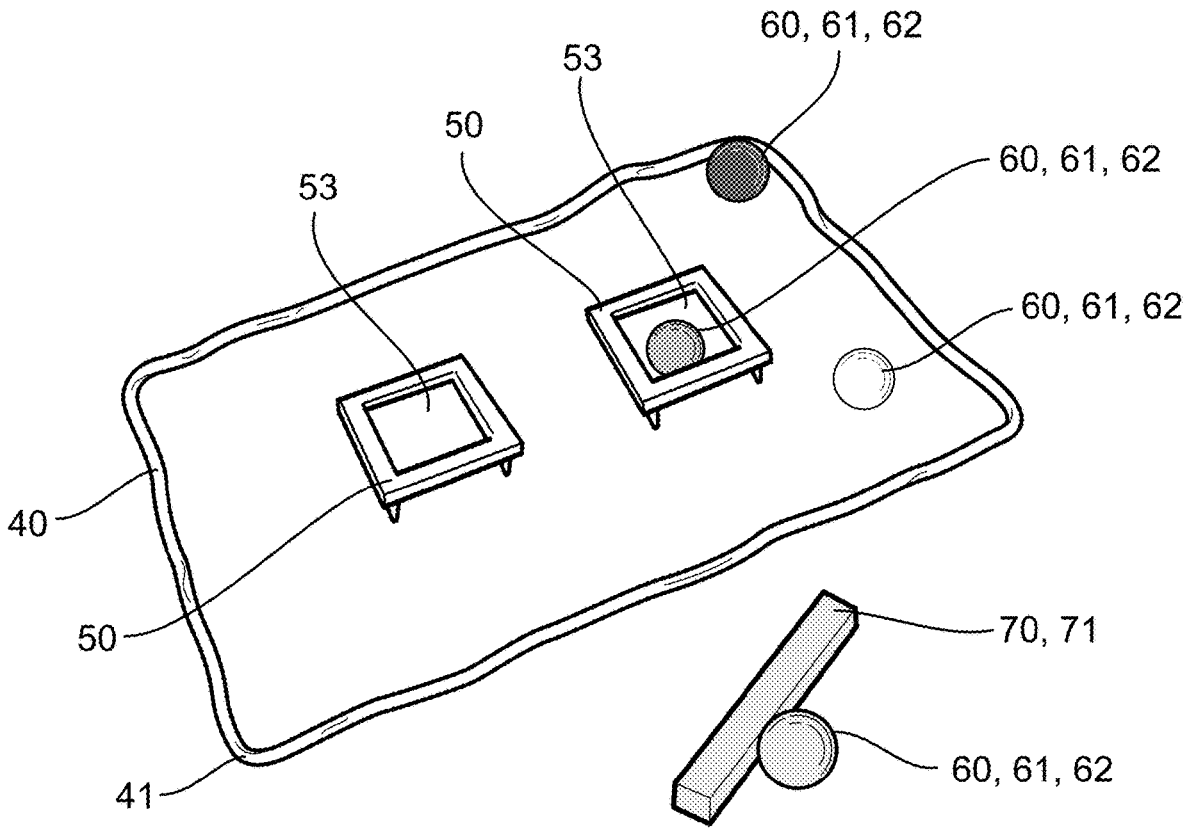
FIG. 7 depicts the game kit in use.

As further shown in FIG. 3, a plurality of targets 50 are stored within the portable carrying case 20. As shown in FIGS. 5-7, the targets 50 are each configured to be positioned within the boundary 40 when the boundary is positioned on the ground surface and formed into the predetermined shape. In certain aspects, each target 50 has a rigid, outer periphery 51 that defines an opening 53 for receiving the offensive implement 60 therein while the game kit 10 is in use. As shown, for example in FIGS. 4 and 6, the rigid, outer periphery 51 has a planar surface such that the rigid, outer periphery is substantially parallel to the ground surface while in use. Each target further includes rigid legs 52 connected to and extending away from the rigid, outer periphery 51. As shown in FIGS. 4 and 6, the target may be square shaped and/or the rigid, outer periphery 51 may include a rigid square shaped, planar face having legs that are connected to and are perpendicular to the planar face. In certain aspects and in view of FIGS. 5 and 7, each rigid leg 52 is configured to be driven in the ground surface thereby temporarily anchoring the target into the ground surface.

As further shown in FIG. 3, a plurality of offensive implements 60 are stored within the portable carrying case 20. These offensive implements 60 are projectiles configured for throwing towards and/or into (e.g., opening 53) at least one of the plurality of targets 50 while the game kit 10 is in use. In certain aspects, each of the offensive elements 60 comprises spherical structures 61. In certain aspects, the spherical structures 61 are balls 62 having the same outer diameter. The balls 62 disclosed herein may be hollow or solid but are preferably solid.

As further shown in FIG. 3, a plurality of blocking implements 70 are stored within the portable carrying case 20. As further shown in FIG. 7, these blocking implements 70 are projectiles that configured to block or impede movement of the offensive implements 60 towards the plurality of targets 50 while the game kit 10 is in use. Specifically, a user may throw the blocking implement towards the boundary 40 and/or target 50, and the blocking implement 70 is configured to block, deflect, impede, and/or stop rotational movement of the offensive implement 60. In certain aspects, each blocking implement 70 is a solid, elongate structure 71 having a predetermined shape. The predetermined shape of the blocking implement 70 may be rectangular or triangular, and as shown in FIG. 7, in certain preferred aspects, the predetermined shape of the blocking implement is rectangular.

Figure 8:
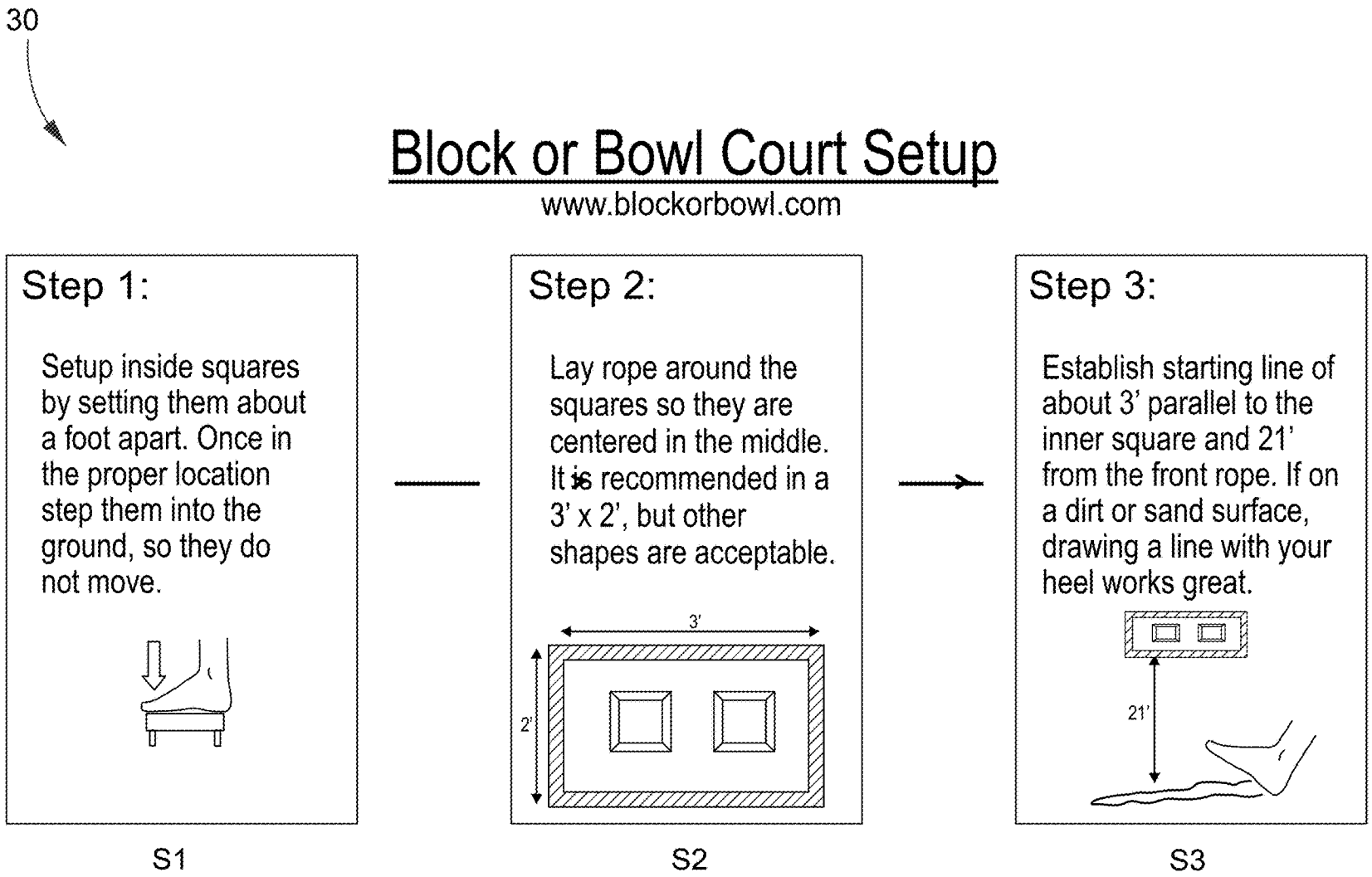
FIG. 8 depicts exemplary instructions providing exemplary steps for preparing to play the game disclosed herein.

FIG. 8 provides exemplary instructions 30 for setting up the game, which may also be stored in carrying case 20. Specifically, FIG. 8 discloses the following steps (S1-S3) for setting up the game disclosed herein. As specifically disclosed in S1 of FIG. 8, the user sets up the inside squares (i.e., plurality of targets 50) by setting each square about one foot apart from one another. Once the targets 50 are in the proper location, force is applied (e.g., by stepping thereon) to each target 50 forcing the legs 52 of the target(s) into the ground so that the target is temporarily fixed and immobilized in the ground. Next, as further disclosed in S2 of FIG. 8, boundary 40 (e.g., endless rope 41) is positioned on the ground surface around/surrounding the targets 50 so that the targets are essentially centered in the middle of the boundary. For example, in certain aspects, it is preferable to form the boundary 40 into a 3'×2' rectangular shape. However, other shapes (circle, triangle, etc.) are acceptable. S3 then follows S2. In S3, a starting line is formed, which is about 3' parallel to the inner squares and 21' from the front of the boundary 40. When on a dirt or sand surface, a line may be drawn with the user's heel.

Figure 9:
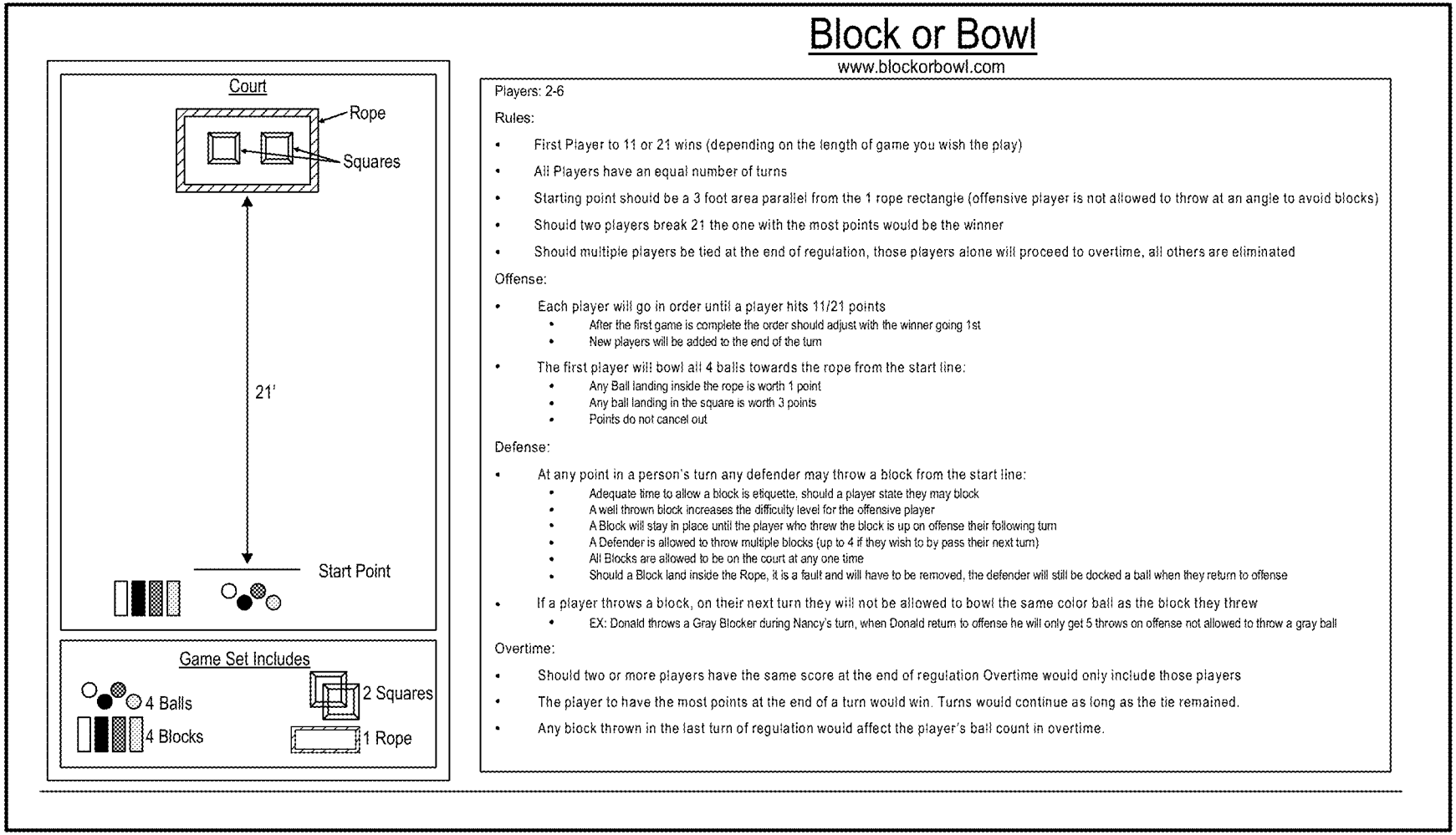
FIG. 9 provides exemplary instructions for playing the game disclosed herein.

FIG. 9 provides exemplary instructions 31 for playing the game, which may also be stored in carrying case 20. Specifically, FIG. 9 discloses that the game from the portable game kit 10 maybe played by two to six players. The general rules of the game are as follows:

General Rules:

First Player to 11 or 21 points wins (depending on the length and score of game played)

All Players have an equal number of turns;

Starting point should be a 3 foot area parallel from the front of boundary 40 (as shown in FIGS. 5 and 7), and the offensive player is not allowed to throw at an angle to avoid blocks;

Should two players break 21 the one with the most points would be the winner; and Should multiple players be tied at the end of regulation, those players alone will proceed to overtime, all others are eliminated As shown in FIG. 9, the offensive rules of the game are as follows:

Offensive Rules:

Each player will go in order until a player hits 11 or 21 points;

After the first game is complete, the order should adjust with the winner going first;

New players will be added to the end of the turn;

The first player will throw the offensive implement 60 (e.g., bowl all 4 balls) towards the boundary 40 and target 50 from the start line:

Any ball (offensive implement 60) landing inside the boundary 40 (as shown in FIG. 7) is worth 1 point;

Any ball landing in the target 50, more specifically opening 53 of the target, (as shown in FIG. 7) is worth 3 points; and Points do not cancel out.

As shown in FIG. 9, the defensive rules of the game are as follows:

Defensive Rules:

At any point in a person's turn, any defender may throw a block (defensive implement 70) from the start line:

Adequate time is provided to allow a block, should a player state they may block;

A well-thrown block (defensive implement 70) increases the difficulty level for the offensive player;

A block (defensive implement 70) will stay in place until the player who threw the block is on offense their following turn;

A defender is allowed to throw multiple blocks (up to 4 if they wish to bypass their next turn);

All blocks (defensive implement 70) are allowed to be on the court at any one time;

Should a block (defensive implement 70) land inside the rope (boundary 40), it is a fault and will have to be removed, the defender will still be docked a ball (offensive implement 60) when they return to offense;

If a player throws a block (defensive implement 70), on their next turn they will not be allowed to bowl (offensive implement 60) the same color ball as the block they threw. For example, Donald (user 1) throws a Gray Blocker during Nancy's (user 2) turn, when Donald returns to offense he will only get 3 throws on offense and is not allowed to throw the gray ball.

As shown in FIG. 9, in certain instances overtime can arise. The rules for overtime are as follows:

Overtime Rules:

Should two or more players have the same score at the end of regulation overtime would only include those players;

The player to have the most points at the end of a turn would win. Turns would continue as long as the tie remained; and Any blocks thrown in the last turn of regulation would affect the player's ball count in overtime.

Figure 10:
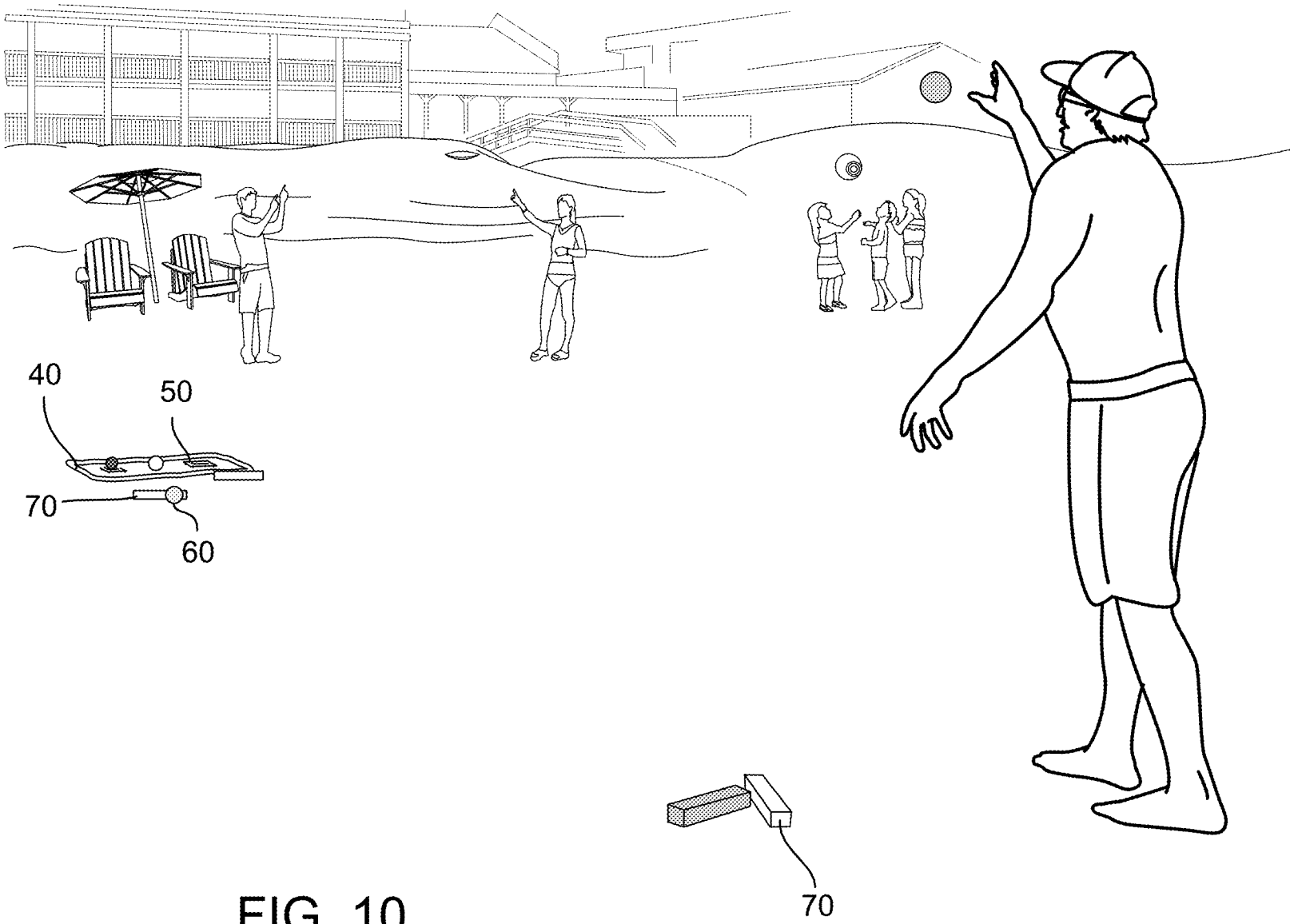
FIG. 10 depicts a user playing the disclosed game.

FIG. 10 depicts a user playing the above disclosed game.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

| Parts List: |
|---|
| Portable Game Kit 10 |
| Portable Carrying Case 20 |
| Handle 21 |
| Locking Mechanism 22 |
| Instructions for Setting-Up Game 30 |
| Instructions for Playing Game 31 |
| Boundary 40 |
| Flexible Endless Rope 41 |
| Anchoring Pins (Not Shown) |
| Plurality of Targets 50 |
| Rigid Outer Periphery 51 |
| Rigid Legs 52 |
| Opening 53 |
| Plurality of Offensive Implements 60 |
| Spherical Structures 61 |
| Balls 62 |
| Plurality of Blocking Implements 70 |
| Solid Elongate Structure 71 |

What is claimed is:

1. A portable outdoor game kit comprising:

(a) a portable carrying case;

(b) a boundary stored within the portable carrying case that is configured to be positioned on a ground surface and formed into a predetermined shape;

(c) a plurality of targets stored within the portable carrying case that are configured to be positioned within the boundary when the boundary is positioned on the ground surface and formed into the predetermined shape;

(d) a plurality of offensive implements stored within the portable carrying case that are configured for throwing towards and/or into at least one of the plurality of targets while the game kit is in use, each offensive implement of the plurality of offensive implements has a distinct color; and (e) a plurality of blocking implements stored within the portable carrying case that are configured for throwing while in use to block or impede movement of the offensive implements towards the plurality of targets while the game kit is in use, each blocking implement of the plurality of blocking implements has a distinct color and each blocking implement of the plurality of blocking implements is a solid, elongate structure having a rectangular or triangular shape, wherein;

each target has a rigid, outer periphery that defines an opening for receiving the offensive implement therein while the game kit is in use, and the plurality of offensive implements correspond in number and distinct color to the plurality of blocking implements.

2. The portable outdoor game kit of claim 1, wherein the boundary is flexible.

3. The portable outdoor game kit of claim 2, wherein the boundary is a flexible endless rope.

4. The portable outdoor game kit of claim 3, wherein the flexible endless rope is configured to rest on the ground while maintaining the predetermined shape.

5. The portable outdoor game kit of claim 4, further comprises anchoring members configured to anchor the flexible endless rope to the ground surface and maintain the predetermined shape.

6. The portable outdoor game kit of claim 5, wherein the rigid, outer periphery has a planar surface such that the rigid, outer periphery is substantially parallel to the ground surface while in use.

7. The portable outdoor game kit of claim 6, each target further comprises rigid legs connected to and extending away from the rigid, outer periphery.

8. The portable outdoor game kit of claim 7, wherein each target is square shaped and each rigid leg of each target is configured to be driven into the ground surface thereby temporarily anchoring the target into the ground surface.

9. The portable outdoor game kit of claim 8, wherein each of the offensive elements comprise spherical structures.

10. The portable outdoor game kit of claim 9, wherein the spherical structures are balls having the same outer diameter.

11. The portable outdoor game kit of claim 10, wherein the balls are hollow or solid.

12. The portable outdoor game kit of claim 11, wherein the balls are solid.

13. The portable outdoor game kit of claim 12, wherein each blocking implement is devoid of an anchoring member.

* * * * *